US009340314B2

(12) United States Patent
Mooney

(10) Patent No.: US 9,340,314 B2
(45) Date of Patent: May 17, 2016

(54) CONTAINER HOOP SUPPORT

(75) Inventor: Michael R. Mooney, Frankfort, IL (US)

(73) Assignee: PLASTIPAK PACKAGING, INC., Plymouth, MI (US)

( * ) Notice: Subject to any disclaimer, the term of this patent is extended or adjusted under 35 U.S.C. 154(b) by 1073 days.

(21) Appl. No.: 11/862,698

(22) Filed: Sep. 27, 2007

(65) Prior Publication Data

US 2008/0093329 A1 Apr. 24, 2008

Related U.S. Application Data

(60) Provisional application No. 60/847,573, filed on Sep. 27, 2006.

(51) Int. Cl.
*B65D 1/02* (2006.01)
*B65D 79/00* (2006.01)

(52) U.S. Cl.
CPC ..... *B65D 1/0223* (2013.01); *B65D 79/005* (2013.01); *B65D 2203/00* (2013.01); *B65D 2501/0018* (2013.01); *B65D 2501/0036* (2013.01)

(58) Field of Classification Search
CPC .. B65D 79/005; B65D 1/023; B65D 2203/00; B65D 2501/15; B65D 2501/0036; B65D 1/0223
USPC ..... 215/379, 380–382, 384; D9/552, 558; 220/624.272, 672
See application file for complete search history.

(56) References Cited

U.S. PATENT DOCUMENTS

| | | | | |
|---|---|---|---|---|
| D84,677 | S | 7/1931 | Blunt | |
| 4,749,092 | A * | 6/1988 | Sugiura et al. | 215/381 |
| D305,984 | S | 2/1990 | Alberghini et al. | |
| D322,562 | S | 12/1991 | Narsutis | |
| 5,148,930 | A | 9/1992 | Ota et al. | |
| 5,224,614 | A | 7/1993 | Bono et al. | |
| 5,226,550 | A | 7/1993 | Mikolaitis | |
| D345,694 | S | 4/1994 | Darvish | |
| D370,634 | S | 6/1996 | Mero et al. | |
| D374,826 | S | 10/1996 | Mackinson et al. | |
| 5,593,056 | A | 1/1997 | Mero et al. | |
| D378,353 | S | 3/1997 | Emre et al. | |
| D379,592 | S | 6/1997 | Doskoczynski | |
| 5,704,503 | A | 1/1998 | Krishnakumar et al. | |
| 5,704,504 | A * | 1/1998 | Bueno | 215/381 |
| D393,802 | S | 4/1998 | Collette et al. | |
| 5,758,790 | A * | 6/1998 | Ewing, Jr. | 215/384 |
| D402,563 | S | 12/1998 | Prevot et al. | |
| D405,000 | S * | 2/1999 | Mikol et al. | D9/670 |
| D406,065 | S | 2/1999 | Cheng | |
| 5,887,739 | A | 3/1999 | Prevot et al. | |
| D415,030 | S | 10/1999 | Searle | |
| 6,036,037 | A * | 3/2000 | Scheffer et al. | 215/381 |
| D423,939 | S | 5/2000 | Ogg | |

(Continued)

*Primary Examiner* — Sue A Weaver
(74) *Attorney, Agent, or Firm* — Greer, Burns & Crain, Ltd.

(57) ABSTRACT

A plastic bottle includes any type of body and hoop supports that encircle the dome. The hoop supports may include continuous wave-like ribs; discontinuous ribs that are overlapping; plural, discrete segments that are inclined and overlapping; plural block-like segments formed of mutually perpendicular rectangles; indicia; horizontal segments in rows that overlap; and series of segments that are mutually interfering and overlaid. The hoop supports provide greater top load performance than conventional deep waist configurations.

13 Claims, 12 Drawing Sheets

(56) References Cited

U.S. PATENT DOCUMENTS

| | | | | | |
|---|---|---|---|---|---|
| D424,948 | S | | 5/2000 | Ullmo | |
| D425,424 | S | | 5/2000 | Cheng et al. | |
| D426,163 | S | * | 6/2000 | Safadi et al. | D9/538 |
| D427,077 | S | | 6/2000 | Heliste et al. | |
| D427,518 | S | | 7/2000 | Steward | |
| D427,905 | S | | 7/2000 | Eberle | |
| D429,166 | S | | 8/2000 | Ogg | |
| D430,036 | S | | 8/2000 | Steward et al. | |
| D431,780 | S | | 10/2000 | DeSwarte et al. | |
| D432,018 | S | | 10/2000 | Steward | |
| D435,219 | S | | 12/2000 | Williams et al. | |
| 6,161,713 | A | | 12/2000 | Krich | |
| 6,213,326 | B1 | | 4/2001 | Denner et al. | |
| D441,641 | S | | 5/2001 | Piccioli et al. | |
| D445,036 | S | | 7/2001 | Goettner et al. | |
| D447,061 | S | | 8/2001 | Peek | |
| D449,533 | S | | 10/2001 | Helps et al. | |
| D451,379 | S | | 12/2001 | Tang | |
| 6,347,717 | B1 | | 2/2002 | Eberle | |
| 6,349,839 | B1 | | 2/2002 | Mooney | |
| D455,964 | S | * | 4/2002 | Patterson | D9/552 |
| D459,234 | S | | 6/2002 | Bourque et al. | |
| D462,013 | S | | 8/2002 | Iizuka et al. | |
| D466,023 | S | | 11/2002 | Eickmeier | |
| D466,024 | S | | 11/2002 | Thierjung et al. | |
| 6,494,333 | B2 | | 12/2002 | Sasaki et al. | |
| 6,497,333 | B1 | * | 12/2002 | Ellis et al. | 215/383 |
| 6,513,669 | B2 | | 2/2003 | Ozawa et al. | |
| 6,575,320 | B2 | | 6/2003 | Ota et al. | |
| D480,314 | S | * | 10/2003 | Johnson et al. | D9/538 |
| 6,662,960 | B2 | | 12/2003 | Hong et al. | |
| 6,749,075 | B2 | | 6/2004 | Bourque et al. | |
| 6,779,673 | B2 | | 8/2004 | Melrose et al. | |
| D496,280 | S | | 9/2004 | Mero et al. | |
| D499,967 | S | * | 12/2004 | Carlson et al. | D9/552 |
| D506,138 | S | | 6/2005 | Zboch et al. | |
| D506,139 | S | | 6/2005 | Zboch et al. | |
| D507,971 | S | * | 8/2005 | Harris et al. | D9/516 |
| 6,932,230 | B2 | | 8/2005 | Pedmo et al. | |
| D509,436 | S | | 9/2005 | Mero et al. | |
| D509,746 | S | | 9/2005 | Mero et al. | |
| D509,747 | S | * | 9/2005 | Carlson et al. | D9/552 |
| D510,031 | S | | 9/2005 | Slat et al. | |
| 6,964,347 | B2 | | 11/2005 | Miura | |
| 6,974,047 | B2 | | 12/2005 | Kelley et al. | |
| 6,981,604 | B2 | * | 1/2006 | Iizuka et al. | 215/381 |
| D514,938 | S | | 2/2006 | Zhang | |
| D515,430 | S | | 2/2006 | Venkataraman et al. | |
| D515,933 | S | | 2/2006 | Mero et al. | |
| 7,004,342 | B2 | | 2/2006 | Bourque et al. | |
| 7,032,770 | B2 | | 4/2006 | Finlay et al. | |
| 7,080,747 | B2 | | 7/2006 | Lane et al. | |
| D527,267 | S | | 8/2006 | Zboch et al. | |
| D530,614 | S | * | 10/2006 | Gatewood | D9/516 |
| D537,348 | S | * | 2/2007 | Beck et al. | D9/520 |
| D538,671 | S | * | 3/2007 | O'Danahue | D9/538 |
| D542,667 | S | * | 5/2007 | Boukobza | D9/555 |
| D549,104 | S | * | 8/2007 | Dimmel et al. | D9/550 |
| D556,592 | S | * | 12/2007 | Gage et al. | D9/552 |
| 2001/0037992 | A1 | | 11/2001 | Tanabe et al. | |
| 2002/0158038 | A1 | | 10/2002 | Heisel et al. | |
| 2003/0000911 | A1 | | 1/2003 | Kelley et al. | |
| 2004/0134872 | A1 | * | 7/2004 | Sasaki et al. | 215/384 |
| 2004/0149677 | A1 | | 8/2004 | Slat et al. | |
| 2005/0029220 | A1 | | 2/2005 | Onoda et al. | |
| 2005/0139572 | A1 | * | 6/2005 | Pedmo et al. | 215/381 |
| 2005/0218107 | A1 | * | 10/2005 | Sabold et al. | 215/382 |
| 2006/0108318 | A1 | | 5/2006 | Chisholm | |
| 2006/0157438 | A1 | | 7/2006 | Livingston et al. | |
| 2006/0186083 | A1 | | 8/2006 | Joshi et al. | |
| 2007/0062907 | A1 | | 3/2007 | Heisner | |
| 2007/0187355 | A1 | * | 8/2007 | Kamineni | 215/384 |
| 2007/0257003 | A1 | * | 11/2007 | Colloud | 215/382 |

* cited by examiner

CONTAINER HOOP SUPPORT

CROSS-REFERENCE TO RELATED APPLICATIONS

This application claims priority under 35 U.S.C. §119(e) to U.S. provisional application No. 60/847,573 filed Sep. 27, 2006, which is incorporated by reference herein in its entirety.

BACKGROUND

Hot-fill plastic bottles are designed to receive a liquid product at about 185 degrees F. Often, vacuum panels are disposed around the circumference of the body of the bottle. The vacuum panels are pulled inward in response to vacuum inside the bottle caused by cooling and contraction of the contents after hot-filling and sealing. The deflection of the panels enables the remainder of the bottle to have its desired shape.

In many hot-fill bottles, a waist is located above the panels. An example of a bottle having a conventional waist 3 is shown in FIG. 1. The conventional waist is typically formed by a relatively deep, concave (when viewed from outside the bottle), unbroken rib that extends around the circumference of the bottle between the body portion 4 (having the panels) and the dome 5. The conventional waist typically has a uniform cross section about the circumference.

A main purpose of the waist is to increase provide support just above the vacuum panels to help keep the bottle dome (above the waist) and the bottle body (below the waist) circular after hot filling. Without waist support, the bottle may become oval or kinked by internal vacuum because, for example, (i) the panels might not all deflect by the same magnitude or at the same time, (ii) the sidewall thickness may not be uniform around the circumference of the bottle, (iii) orientation or heat treating or cooling of the bottle may not be uniform, or a combination of these and other reasons.

The top load rating of the bottle, and of the waist, is important for stacking and filling. Conventional waist configurations have the drawback of poor top load performance. In this regard, when a downward load is applied to the top of the container, the force is transmitted through the dome to the upper part of the waist, where a large bending moment is created. Conceptually, the innermost part of the waist forms a hinge about which the upper and lower walls may pivot. Conventional waists, which often are not covered by a label because of their positions at the base of the dome, are also generally considered unappealing to consumers.

U.S. Pat. No. 6,932,230 (Pedmo) discloses a hot fill container having a discontinuous rib in its body below the waist and above its vacuum panels. U.S. Pat. No. 6,036,037 (Scheffer) discloses a hot fill container having a row of rib segments in its body above and below its vacuum panels. Both the Pedmo and Scheffer references disclose a conventional waist.

There is a general need for improved waist configurations in containers.

SUMMARY

A hot fill container includes a base, a body portion that includes vacuum panels, a dome, a finish, and hoop support. The hoop support includes various shapes, and generally includes either a continuous wave-like structure or plural shapes that are arranged circumferentially such that one shape overlaps an adjacent. Such structure provides significant increases of top load performance compared with a conventional waist without sacrificing or having only a small decrease in vacuum performance. The present invention also encompasses employing the hoop supports described herein in bottles that are not intended for hot-filling.

The present invention is not limited to the hoop support structure being located in the top portion. Rather, the present invention encompasses employing the hoop support described herein in the body of the container. For example, any of the hoop supports described herein may be employed in place of the circumferential rib that is typically employed above the vacuum panels and below the shoulder. Further, any of the hoop supports may be employed in place of, or to form, a shoulder.

Preferably, the body of the bottle having the hoop support is approximately circular or cylindrical, and the dome is circular in transverse cross section, because the top load issues of the conventional rib described in the background section are most problematic with circular bottles. And preferably spaces between the segments and the segments themselves are approximately circular arcs. The present invention, however, is not limited to circular bottles and encompasses bottles having other shapes unless specifically recited in the claims. Furthermore, the present invention is not limited to containers or domes having superior top load performance, and the hoop supports may be covered by a label.

Some attributes of a conventional waste configuration are described in this specification. The hoop supports of the present invention(s) does not preclude employing some features of a conventional waist. Rather, the claims define the scope of the invention. Further, the preferred embodiments of the domes having the inventive hoop supports have no conventional waste, but the present invention is not so limited unless specifically recited in the claims.

DETAILED DESCRIPTION OF ILLUSTRATIVE EMBODIMENTS

Figure 28:
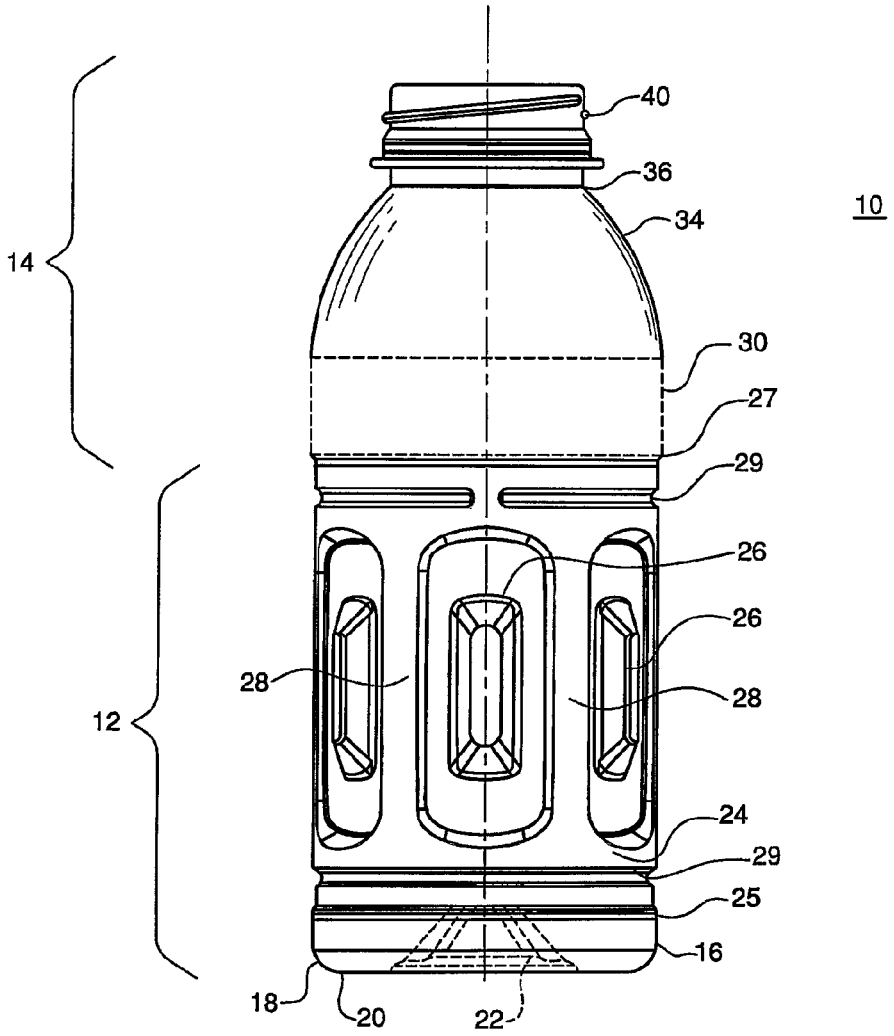
FIG. 28 is a hot fill bottle that may be employed with any of the embodiments of the present invention.

The figures illustrate various embodiments of hoop supports for hot fill containers. As illustrated in FIG. 28, a container 10 includes a bottom portion 12 and a top portion 14. Bottom portion 12 includes an enclosed base 16 and a body 24. Base 16 includes a heel 18 that extends downwardly to a standing ring 20. Preferably, heel 18 is circular in transverse cross section. A reentrant portion 22, which is shown in dashed lines in FIG. 28, extends upwardly from standing ring 20 on the underside of bottle 10.

Body 24 preferably is cylindrical and includes several vacuum panels 26 located about its circumference. The vacuum panels 26 are separated by posts 28, which preferably are stiff relative to the compliant panels 26. Body 24 preferably is separated from heel 18 by a shoulder 25, or by other structure (not shown in the figure) such as a rib. Preferably, a rib 29 is located in body 24 above panels 26 and a below shoulder 27.

Figure 29:
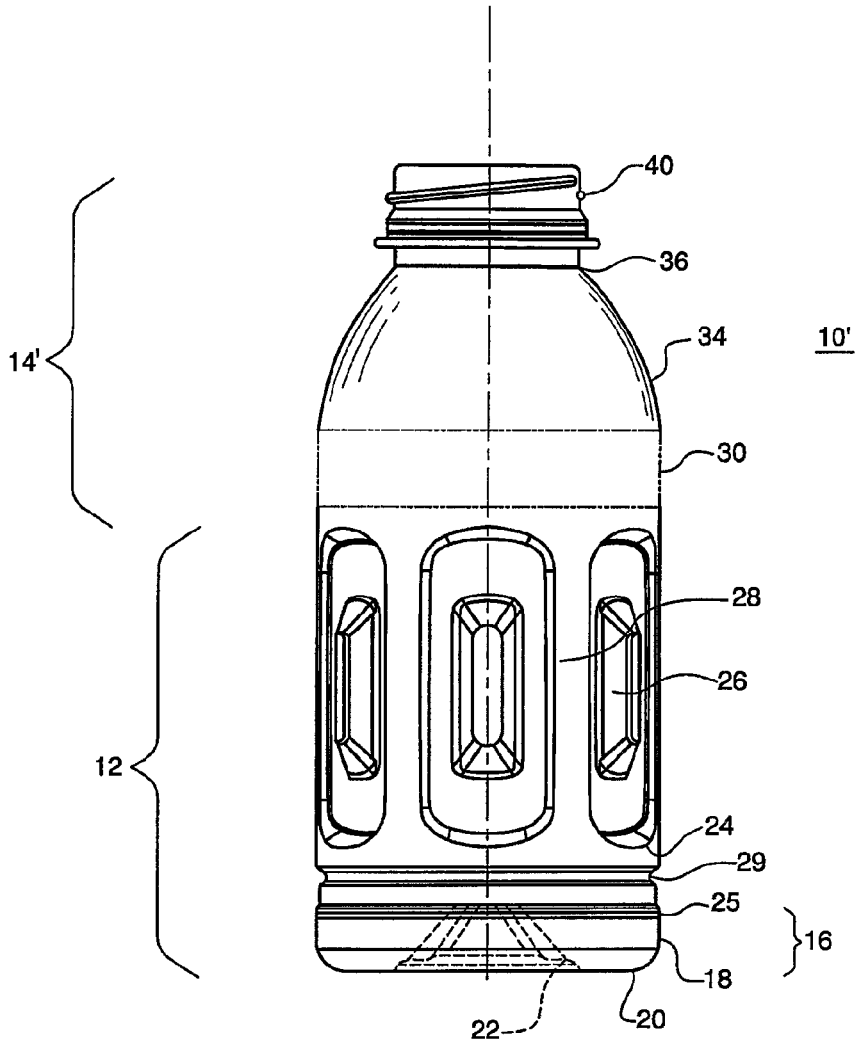
FIG. 29 is another hot fill bottle that may be employed with any of the embodiments of the present invention.

Top portion 14 extends upwardly from body 24. Preferably, top portion 14 is separated from body 24 by shoulder 27, or by other structure (not shown in the figure) such as a rib. Top portion 14 includes a hoop support 30 formed on or in a dome 34. Hoop support 30 is shown in FIGS. 28 and 29 merely as a rectangle to indicate that any of the embodiments of hoop support 30, 130, 230, 330, 430, 530, 630, and/or 730, with (or without) any appended letter designation, are intended for insertion in the rectangle shown in FIG. 28. Several of the drawings show a dome having an upper and lower hoop support, and each hoop support is described in the text as a separate embodiment. Showing two hoop supports in some drawings is merely for convenience of illustration as each hoop support may be separately applied to a dome.

Dome 34 may include a transition between body 24 and hoop support 30, and dome 34 extends upwardly to a neck 36 and a finish 40 formed on or above neck 36. A closure (not shown in the figures) is applied to finish 40 to seal the container upon filling.

FIG. 29 illustrates another container 10' that may employ any of the hoop supports 30. Container 10' includes a bottom portion 12 and a top portion 14'. Bottom portion 12 includes an enclosed base 16 and a body 24. Base 16 includes a heel 18 that extends downwardly to a standing ring 20. Preferably, heel 18 is circular in transverse cross section. A reentrant portion 22, which is shown in dashed lines in FIG. 28, extends upwardly from standing ring 20 on the underside of bottle 10.

Body 24 preferably is cylindrical and includes several vacuum panels 26 located about its circumference. The vacuum panels 26 are separated by posts 28, which preferably are stiff relative to the compliant panels 26. Body 24 preferably is separated from heel 18 by a shoulder 25, or by other structure (not shown in the figure) such as a rib. Preferably, a rib 29 is located in body 24 above panels 26 and a below shoulder 27. Alternatively, a hoop support 30 may be employed in place of rib 29.

Top portion 14' extends upwardly from body 24. Preferably, top portion 14' includes a hoop support 30 formed below a dome 34. A closure (not shown in the figures) is applied to finish 40 to seal the container upon filling. Hoop support 30 is shown in FIG. 29 merely as a rectangle to indicate that any of the embodiments of hoop support 30, 130, 230, 330, 430, 530, 630, and/or 730, with (or without) any appended letter designation, are intended for insertion in the rectangle shown in FIG. 29. Several of the drawings show a dome having an upper and lower hoop support, and each hoop support is described in the text as a separate embodiment. Showing two hoop supports in some drawings is merely for convenience of illustration as each hoop support may be separately applied to a dome.

Hoop supports 30 generally provide improved top load strength without significantly sacrificing vacuum capability. For some embodiments, vacuum capability in increased. Even for the configurations in which vacuum capability is less than the conventional waist, the magnitude of the lessened vacuum capability is not considered critical because of the magnitude in improved top load characteristics and because, in some circumstances, the vacuum capability is not the most critical parameter in bottle failure.

For the embodiments shown in FIGS. 2 through 8, top load and vacuum capability were calculated using finite element analysis. The values for top load performance, which is based on a predetermined change in dimension, relative to a conventional waist are provided below in table 1. The increase in top load strength is based on a comparison of evenly distributed load onto the finish of the embodiments shown and described in the figures with a container of a like size having a conventional waist configuration. Vacuum capability is based on a uniformly applied load by the internal vacuum about the hoop.

TABLE 1

| | FIG. | | | | | | | |
|---|---|---|---|---|---|---|---|---|
| | 2 | 3 | 4A | 4B | 5 | 6 | 7 | 8 |
| % increase in top load performance | 77.1 | 74.1 | 85.0 | 63.1 | 117.4 | 114.5 | 117.0 | 108.9 |
| % change in vacuum capability | 9.3 | 2.9 | 3.9 | −5.0 | −3.2 | −1.4 | −6.8 | −6.8 |

Based on the calculated performance of the embodiments of FIGS. 2 through 8 and the insights gained through the design and testing process, the inventor conceived of the embodiments shown in FIGS. 9 through 24, which are expected to provide improved top load performance with acceptable vacuum capability or stiffness. Hoop supports 30 also enable decoration or indicia to be displayed. Preferably, the hoop supports have an overall transverse cross section that is circular, rather than deviating from the circular sidewall cross section.

Figure 1:
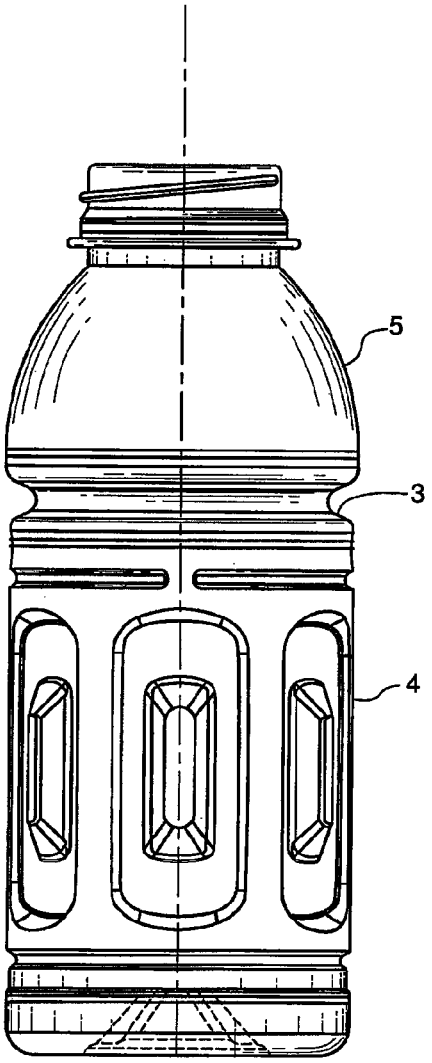
FIG. 1 (PRIOR ART)
FIG. 1 (PRIOR ART) illustrates a conventional hot fill container having a conventional waist.
Figure 2:
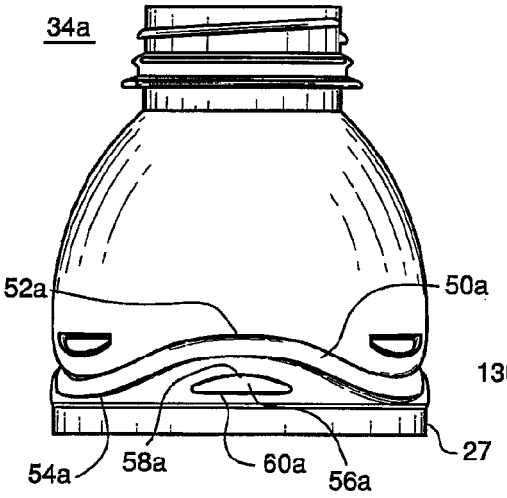
FIG. 2 illustrates a portion of a container according to an embodiment of the present invention.

FIG. 2 illustrates an example of a waist configuration of the present invention. Hoop support 30*a* of dome 34*a* includes a continuous wave-like rib 50*a* that extends around the circumference of top portion 14. Rib 50*a* includes alternating peaks 52*a* and valleys 54*a* when viewed in elevational or isometric view. Short rib segments 56*a* may (optionally) be located below each peak 52 and above each valley 54. Each segment 56*a* is formed by an arc or curved portion 58*a* nearest rib 50*a* (that is, the arc or curved portion is the lower portion of the segments 56*a* that are above the valleys 54*a* and is the upper portion of the segments 56*a* that are below the peaks 52*a*). Each segment 56*a* has a straight portion 60*a* opposite the curved portion 58*a*. Short rib segments 56 may enhance the strength or stiffness of waits 30*a* and enhance gripping by the user.

Preferably, the portions of hoop support 30*a* outside of ribs 50*a* and segments 56*a* is in transverse cross section without vertically oriented ribs or corrugation, and the outermost surfaces of ribs 50*a* and segments 56*a* fall onto a circular cylinder. The present invention is not limited to such structure, however.

Figure 21:
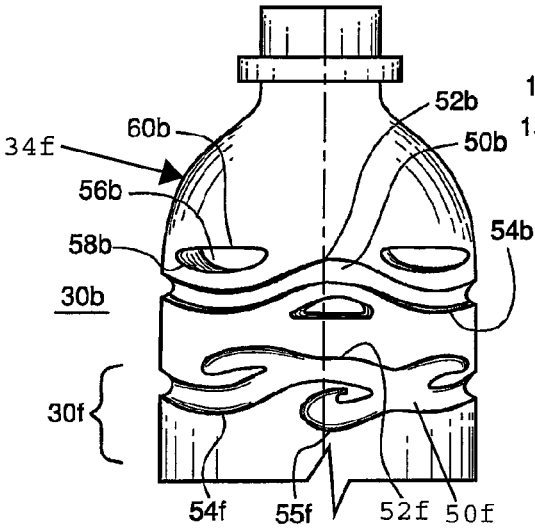
FIG. 21 illustrates another pair of portions for a container according to additional embodiments of the present invention.

The top portion of FIG. 21 illustrates hoop support 30*b* having a continuous wave-like rib 50*b* having segments 56*b* disposed below peaks 52*b* and above valleys 54*b*. Each segment 56*b* is formed by an arc or curved portion 58*b* nearest rib 50*b* (that is, the arc or curved portion is the lower portion of the segments 56*b* that are above the valleys 54*b* and is the upper portion of the segments 56*b* that are below the peaks 52*b*). Each segment 56*b* has a straight portion 60*b* opposite the curved portion 58*b*. Segments 56*b* are similar in shape to segments 56*a* of hoop support 30 illustrated in FIG. 2, but larger.

Figure 23:
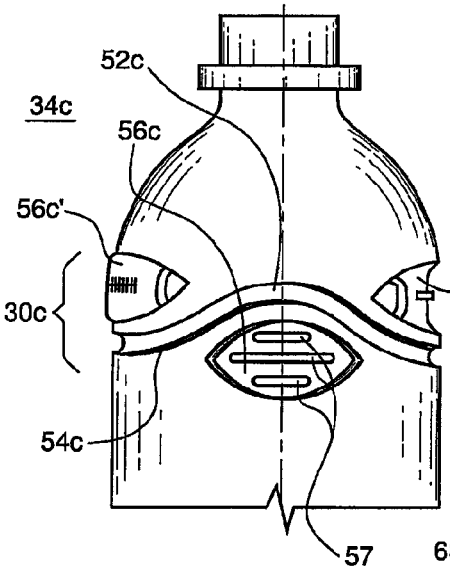
FIG. 23 illustrates a portion of a container according to another embodiment of the present invention.

FIG. 23 illustrates hoop support 30*c* having a continuous wave-like rib 50*c* having segments disposed below peaks 52*c* and above valleys 54*c*. The segments encompass various structure, including a raised ellipsoid 56*c* (shown in the center of FIG. 23) having either raised or depressed, short parallel ribs 57. Ellipsoid 56*c* may also be formed by a depression (not shown in the figures). Ellipsoid 56*c* and ribs 57 enhance gripping. The segments may also be indicia, such as the football images shown as an embossment 56*c*' on the left of FIG. 23 and as a debossment or recess 56*c*" on the right side of FIG. 23. The football images 56*c*' and 56*c*" illustrate the kinds of indicia that may be employed to enhance the appearance, or the structural and functional aspects, or both, of hoop support 30*c*.

Figure 9:
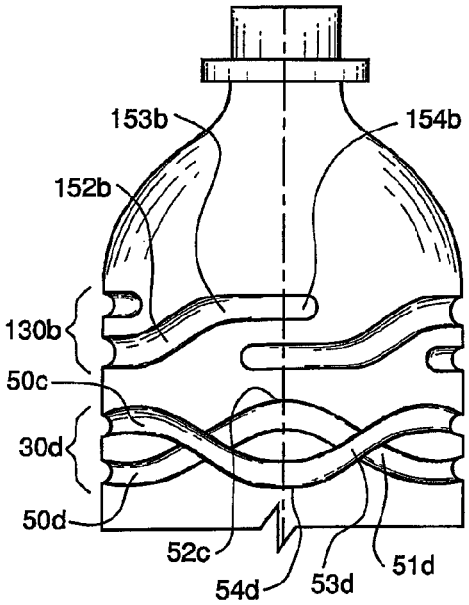
FIG. 9 illustrates a pair of portions for a container according to additional embodiments of the present invention.

The lower portion of FIG. 9 illustrates a hoop support 30*d* having a pair of continuous wave-like ribs 50*d*, each of which includes peaks 52*d* and above valleys 54*d*. Ribs 50*d* are complementary such that the depth or appearance is varied where the ribs converge to provide an appearance of a pair of twisted strands. An underpassing portion 51*d* has a diminished radial dimension (that is, height) relative to the overpassing portion 52*d* to provide twisted appearance.

Preferably, each rib 50*d* is recessed relative to the surrounding portions of dome 34 and overpassing portion 53*d* is recessed by a smaller dimension that underpassing portion 51*d*. The present invention encompasses raised ribs and ribs having a portion raised and other portions recessed.

Figure 22:
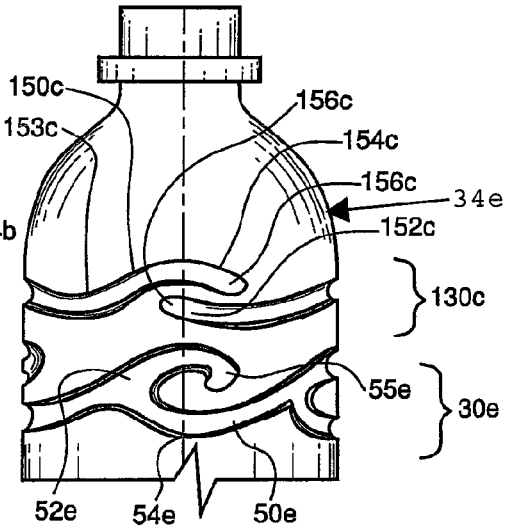
FIG. 22 illustrates another pair of portions for a container according to additional embodiments of the present invention.

The lower portion of FIG. 22 illustrates a hoop support 30*e* having a continuous rib having 50*e* that extends around the circumference of dome 34*e*. Rib 50*e* includes alternating peaks 52*e* and valleys 54*e*. A protrusion 55*e* having the appearance of a breaking ocean wave extends from each peak 52*e*.

The lower portion of FIG. 21 illustrates a hoop support 30*f* having a continuous rib 50*f* that extends around the circumference of dome 34*f*. Rib 50*f* includes alternating peaks 52*f* and valleys 54*f*, and includes extensions 55*f* that extend from the ribs between the apexes of the peaks and valleys. Extensions 55*f* are a elongated swirl or eddy.

Preferably, the portions of hoop supports 30*a*, 30*b*, 30*c*, 30*d*, 30*e*, and 30*f* outside of the identified features 50*a*, 50*b*, 50*c*, 50*d*, 50*e*, and 50*f* and outside their complimentary or additional raised or recessed features, such as features 56*a*, 56*b*, and 56*c*, are circular in transverse cross section without vertically oriented ribs or corrugations. And the innermost surfaces of the recessed portions of the ribs are coincident with a circular cylinder having its centerline collinear with the bottle longitudinal centerline. If any of the surfaces of the ribs are raised, then the outermost surfaces of the raised portions are coincident with a circular cylinder having its centerline collinear with the bottle longitudinal centerline. The present invention, however, is not limited to structure described in this paragraph.

Figure 3:
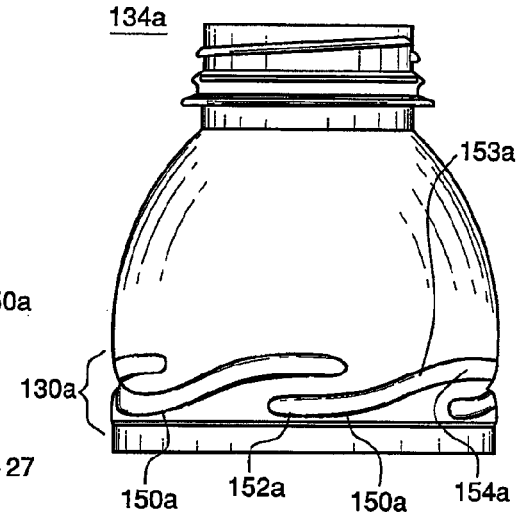
FIG. 3 illustrates a portion of a container according to another embodiment of the present invention.

FIG. 3 illustrates another aspect of a hoop support of the present invention. Hoop support 130*a* of dome 134*a* includes several elongate rib segments 150*a* that together extend around the circumference of top portion 114. Each rib segment 150*a* is spaced apart from adjacent segments, and each includes a first portion 152*a* proximate an end, a second portion 154*a* proximate an opposing end, and an intermediate portion 153*a* between the first and second portions 152*a* and 154*a*.

Preferably, first portion 152*a* is a lower portion and second portion 154*a* is an upper portion (as viewed in elevation and shown in FIG. 3). Adjacent segments 150*a* are overlapping such that upper portion 154*a* is located vertically overtop of lower portion 152*a* of the adjacent segment. In this regard upper portion 154*a* overhangs lower portion 152*a* of its adjacent segment. Preferably, each lower portion 152*a* and upper portion 154*a* are app approximately straight and parallel at the tips of segments 150*a* and intermediate portion 153*a* is curved such that segment 150*a* has the shape of an elongated S. The term overhanging, as used herein, refers to an upper structure that is generally vertically (in elevational view) superior to a lower structure and such that a vertical line drawn on the surface of the bottle (or a plane bisecting the longitudinal centerline of the bottle) intersects both the upper structure and the lower structure. The term overlapping refers to a like vertical relationship of the two structures, but without indicating which structure is on top.

The top portion of FIG. 9 illustrates hoop support 130*b*, which is identical to that of hoop support 130*a* except for the dimensions of shape of segments 150*b*.

The top portion of FIG. 22 illustrates hoop support 130*c* of dome 34*e* having elongate rib segments 150*c* that together extend around the circumference of the bottle. Each rib segment 150*c* is spaced apart from adjacent segments, and each includes a first portion 152*c* proximate an end, a second portion 154*c* proximate an opposing end, and an intermediate portion 153*c* between the first and second portions 152*c* and 154*c*. Preferably, upper portion 154*c* is trending downwardly such that a tangent to it at tip 156*c* has a negative slope; and lower portion 152*c* is trending upwardly such that a tangent to it at tip 156*c* has a positive slope.

Figure 10:
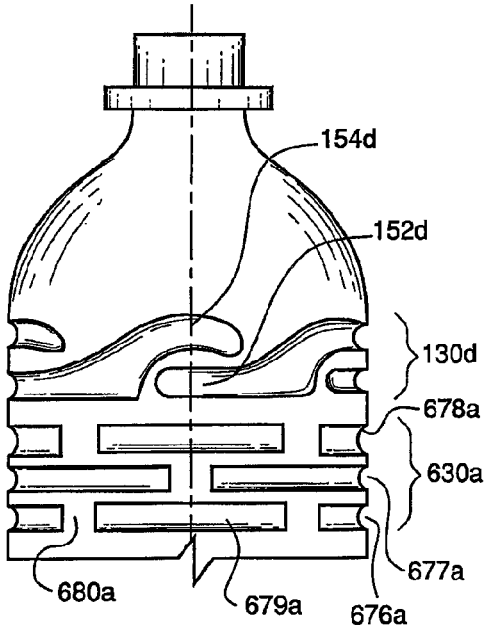
FIG. 10 illustrates another pair of portions for a container according to additional embodiments of the present invention.

The top portion of FIG. 10 illustrates hoop support 130*d* of dome 134*d*. Hoop support 130*d* includes rib segments 150*d* that together extend around the circumference of the bottle. Each rib segment 150*d* is spaced apart from adjacent segments, and each includes a first portion 152*d* proximate a lower end and a second portion 154*d* proximate an opposing upper end. Each segment has the appearance of a breaking wave such that upper end 154*c* appears to be breaking on or overtop, or overhanging, lower portion 152*a*.

Figure 4A:
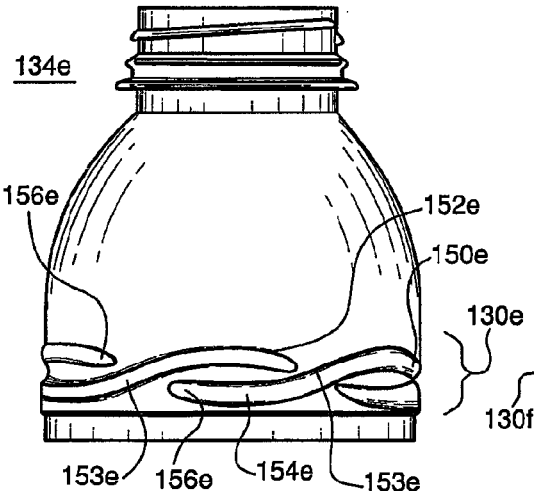
FIG. 4A illustrates a portion of a container according to another embodiment of the present invention.

FIG. 4A illustrates hoop support 130*e* of dome 134*e*, which includes several elongate rib segments 150*e* that together extend around the circumference of top portion 114*e*. Each rib segment 150*e* is spaced apart from adjacent segments, and each includes a first portion 152*e* proximate an end, a second portion 154*e* proximate an opposing end, and an intermediate portion 153*e* between the first and second portions 152*e* and 154*e*. First and second portions 152*e* and 154*e* generally define the lower and upper portions and terminate at tips 156*e*.

Upper portion 154*e* is trending downwardly such that a tangent to it at tip 156*e* has a negative slope; and lower portion 152*e* is trending upwardly such that a tangent to it at tip 156*e* has a positive slope. Preferably, each segment 150*e* is recessed relative to the surrounding dome surface, and the depth of the recess relative to the surrounding dome surface diminishes near its tips 156*e*. Because tips 156*e* are near the intermediate portions 153*e*, segments 150*e* give the appearance of twisted strands.

Figure 4B:
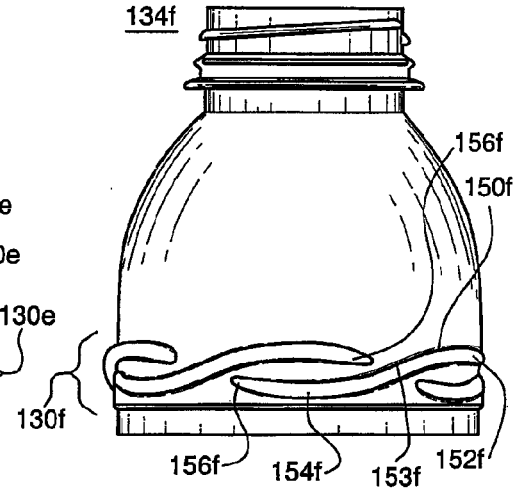
FIG. 4B illustrates a portion of a container according to another embodiment of the present invention.

FIG. 4B illustrates hoop support 130*f* of dome 134*f*, which includes several elongate rib segments 150*f* that together extend around the circumference of top portion 114*e*. Hoop support 130*f* is similar to hoop support 130*e*, but rib segments 150*f* are raised relative to the surrounding dome surface. In this regard, each rib segment 150*f* is spaced apart from adjacent segments, and each includes a first portion 152*f* proximate an end, a second portion 154*f* proximate an opposing end, and an intermediate portion 153*f* between the first and second portions 152*f* and 154*f*.

Upper portion 154*f* is trending downwardly such that a tangent to it at tip 156*f* has a negative slope; and lower portion 152*f* is trending upwardly such that a tangent to it at tip 156*f* has a positive slope. Preferably, each segment 150*f* is raised relative to the surrounding dome surface, and its radial height relative to the surrounding dome surface diminishes near its tips 156*f*. Because tips 156*f* are near the intermediate portions 153*f*, segments 150*f* give the appearance of twisted strands.

Preferably, the portions of hoop supports 130*a*, 130*b*, 130*c*, 130*d*, 130*e*, and 130*f* outside of the identified features 150*a*, 150*b*, 150*c*, 150*d*, 150*e*, and 150*f* and outside their complimentary or additional raised or recessed features (not shown in the figures), are circular in transverse cross section without vertically oriented ribs or corrugations. And the innermost surfaces of the recessed portions of the ribs are coincident with a circular cylinder having its centerline collinear with the bottle longitudinal centerline. If any of the surfaces of the ribs are raised, then the outermost surfaces of the raised portions are coincident with a circular cylinder having its centerline collinear with the bottle longitudinal centerline. The present invention, however, is not limited to structure described in this paragraph.

Figure 5:
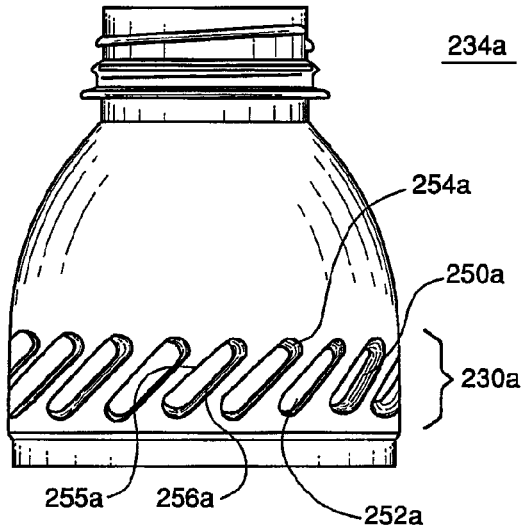
FIG. 5 illustrates a portion of a container according to another embodiment of the present invention.

A hoop support formed by discrete segments that generally overlap, when viewed in elevation, form another aspect of the present invention. FIG. 5 illustrates dome 234*a* with a hoop support 230*a* having several discrete segments 250*a* that are arranged about the circumference of the bottle. Each segment or notch 250*a* is short and straight, and is inclined relative to a vertical axis. An upper portion 254*a* overhangs a lower portion 254*a* of its adjacent notch.

Preferably, each notch 250*a* is formed by parallel lateral sidewalls 255*a* and 256*a*, each of which is inclined relative to the vertical axis. A first inclined lateral wall 256*a* overhangs the second inclined lateral sidewall 255*a* of the adjacent notch.

Figure 13:
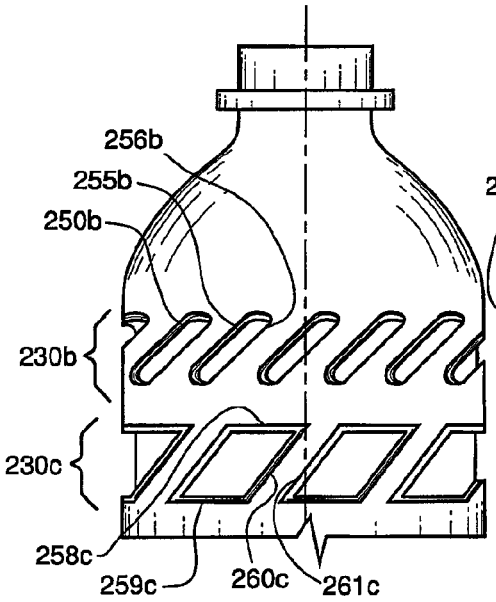
FIG. 13 illustrates another pair of portions for a container according to additional embodiments of the present invention.

The top portion of FIG. 13 illustrates hoop support 230*b* having notches 250*b* that are as described above with respect to hoop support 230*a* of FIG. 5, except notches 230*b* have different dimensions from those of hoop support 230*a*. Preferably, the angle of inclination of notches 230*b* is between approximately 30 and 50 degrees, and more preferably about 40 degrees, form a vertical line. As described more fully below, the inclination of the notches and the dimensions in general depend on several parameters that will be understood by persons familiar with bottle engineering.

Figure 6:
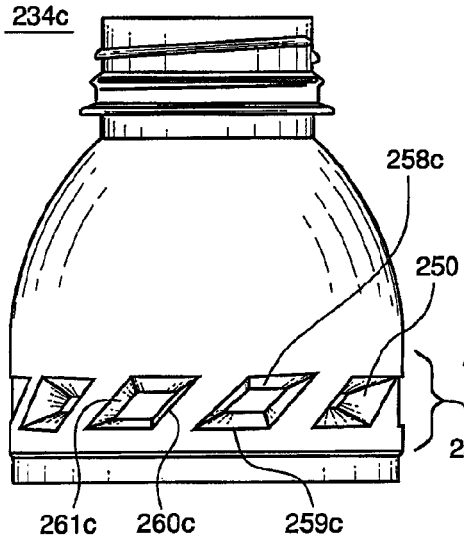
FIG. 6 illustrates a portion of a container according to another embodiment of the present invention.

FIG. 6 illustrates hoop support 230*c* having several discrete segments 250*c* arranged about the circumference of the bottle. Each segment 250*c* is a parallelogram, and preferably a rhombus, having its upper and lower edges 258*c* and 259*c* horizontally oriented. The lateral sidewalls 260*c* and 261*c* are mutually parallel and oblique relative to a vertical axis. Preferably, a first inclined lateral wall 260*c* overhangs the second inclined lateral sidewall 261*c* of the adjacent notch.

The bottom portion of FIG. 13 illustrates hoop support 230*d* having segments 250*d* that are as described above with respect to hoop support 230*c* except parallelograms 250*d* have different dimensions from those of hoop support 230*c*.

Figure 14:
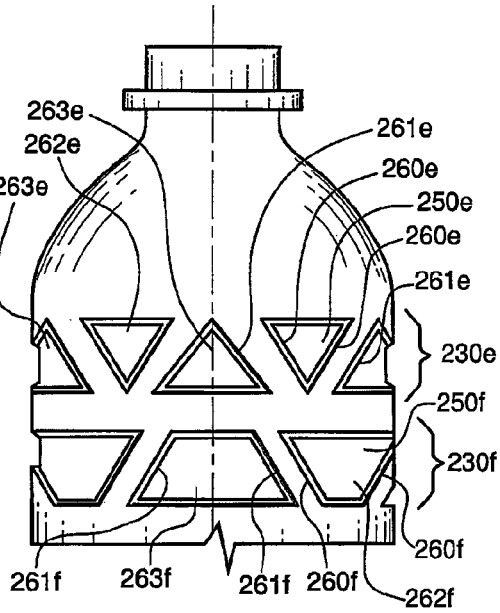
FIG. 14 illustrates another pair of portions for a container according to additional embodiments of the present invention.

For the embodiments having overlapping lateral sidewalls, the invention is limited neither to parallelograms or to straight sidewalls. The top portion of FIG. 14 illustrates hoop support 230*e* having several discrete segments 250*e* arranged about the circumference of the bottle. Segments 250*e* are oppositely oriented triangles having lateral sidewalls 260*e* and 261*e* that are oblique relative to a vertical axis. The triangles are oriented such that the lateral sidewalls 260*e* of the downwardly oriented triangles 262*e* are overhanging or overlapping the laterals sidewalls 261*e* of upwardly oriented triangles 263*e*.

The lower portion of FIG. 14 illustrates hoop support 230*f* illustrates hoop support 230*f* having several discrete segments 250*f* arranged about the circumference of the bottle. Segments 250*f* are oppositely oriented trapezoids having lateral sidewalls 260*f* and 261*f* that are oblique relative to a vertical axis. The trapezoids are oriented such that the lateral sidewalls 260*f* of the downwardly oriented trapezoids 262*f* are overhanging or overlapping the laterals sidewalls 261*f* of upwardly oriented trapezoids 263*f*.

Figure 15:
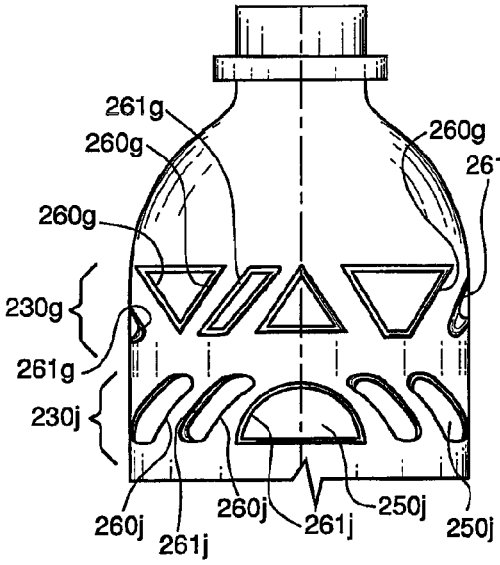
FIG. 15 illustrates another pair of portions for a container according to additional embodiments of the present invention.
Figure 16:
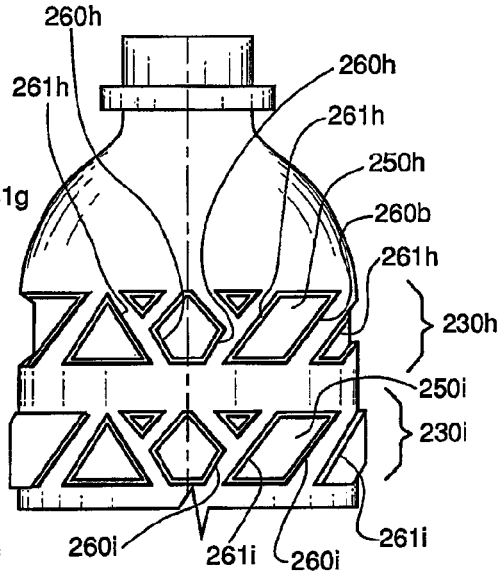
FIG. 16 illustrates another pair of portions for a container according to additional embodiments of the present invention.

The upper portion of FIG. 15 and the upper and lower portions of FIG. 16 illustrate hoop supports 230*g*, 263*h*, and 263*i* which are formed by discrete segments 250*g*, 250*h*, and 250*i* that comprise various shapes, such as pentagons, parallelograms, and triangles. Each of these three embodiments have mutually overlapping lateral sidewalls.

Hoop support 230*g* includes triangles, trapezoids, and parallelograms 250*g* having oblique lateral sidewalls 260*g* that overhang or overlap laterals sidewalls 261*g* of adjacent shapes. Hoop support 230*h* includes pentagrams, triangles, and parallelograms 250*h* having oblique lateral sidewalls 260*h* that overhand or overlap lateral sidewalls 261*h* of adjacent shapes. Hoop support 230*i* has the same shapes and arrangement as that of hoop support 230*h* of the top portion of FIG. 16, but the shapes are raised relative to the surface of dome 234*i*. Raised segments 250*h* provide a label protection because of their diameter is larger the body's circumference, and may also be used as a label bumper or shoulder.

The lower portion of FIG. 15 illustrates hoop supports 230*j* having several discrete segments 250*j* arranged around the circumference. Segments 250*j* include curved notches and half circles that are overhanging or overlapping. In this regard, lateral sidewalls 260*i* overhang or overlap lateral sidewalls 261*j* of adjacent sidewalls.

Preferably, the portions of hoop support 230*a*, 230*b*, 230*c*, 230*d*, 230*e*, 230*f*, 230*g*, 230*h*, 230*i*, and 230*j* outside of the identified features 250*a*, 250*b*, 250*c*, 250*d*, 250*e*, 250*f*, 250*g*, 250*h*, 250*i*, and 250*j* and outside their complimentary or additional raised or recessed features (not shown in the figures), are circular in transverse cross section without vertically oriented ribs or corrugations. And the innermost surfaces of the recessed portions of the ribs are coincident with a circular cylinder having its centerline collinear with the bottle longitudinal centerline. If any of the surfaces of the ribs are raised, then the outermost surfaces of the raised portions are coincident with a circular cylinder having its centerline collinear with the bottle longitudinal centerline. The present invention, however, is not limited to structure described in this paragraph.

Figure 11:
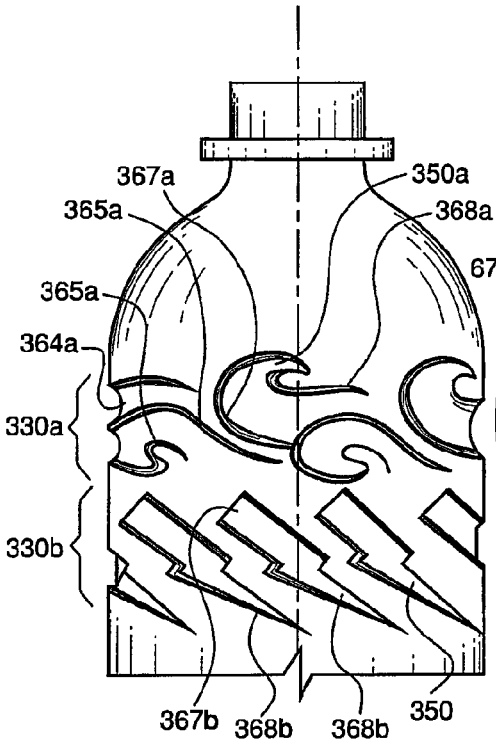
FIG. 11 illustrates another pair of portions for a container according to additional embodiments of the present invention.
Figure 12:
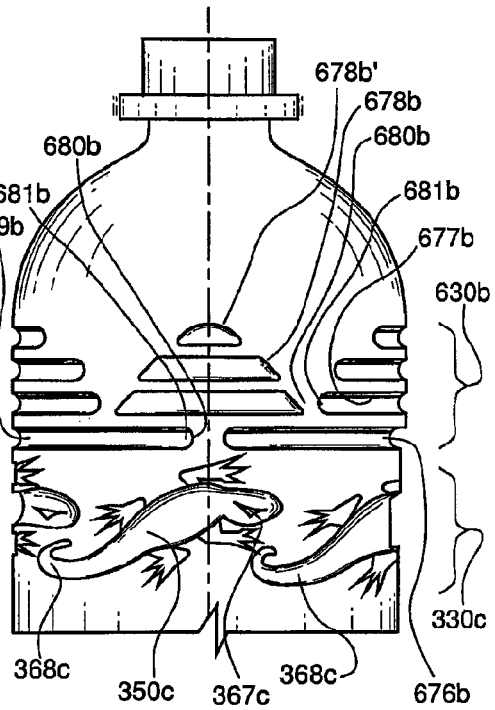
FIG. 12 illustrates another pair of portions for a container according to additional embodiments of the present invention.
Figure 24:
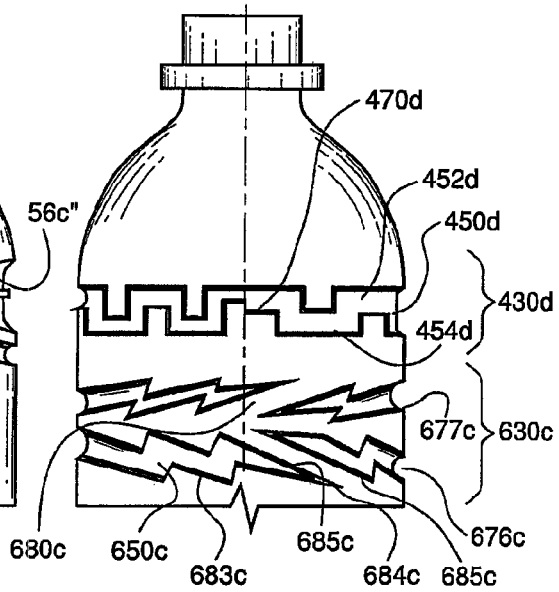
FIG. 24 illustrates another pair of portions for a container according to additional embodiments of the present invention.

The top and bottom portions of FIG. 11, the bottom portion of FIG. 12, and the bottom portion of FIG. 24 illustrate another aspect of the present invention in which hoop supports 330*a*, 330*b*, 330*c*, and 330*d* include plural discrete segments or patterns that are arranged in a mutually overhanging and under cutting pattern. The top portion of FIG. 11 includes segments 350*a* that together extend around the circumference of dome 334*a* in a pair of rows. Each segment is an image of a partial swirl or of an eddy. The row of top swirls 364*a* is interspaced with a row of bottom swirls 365*a* such that the left portion 367*a* of top swirl 364*a* overhangs or overlaps a portion of the adjacent bottom swirl 365*a* on its left, and the right portion 368*a* of top swirl 364*a* overhangs or overlaps a portion of the adjacent bottom swirl 365*a* on its right.

The bottom portion of FIG. 11 illustrates a hoop support 330*b* of dome 334*b*. Hoop support 330*b* includes plural elements 350*b* having jagged sides, one flat end, and an opposing pointed end to form lightning-bolts or electricity symbols that extend about the circumference of dome 334*b*. Each symbol 350*b* is inclined relative to a vertical axis such that a top portion 367*b* (that is, a left portion, which is the flat end, as oriented in FIG. 11) overhangs the bottom portion 368*b* of its adjacent symbol 350*b*.

The bottom portion of FIG. 12 illustrates a hoop support 330*c* of dome 334*c*. Hoop support 330*c* includes plural elements 350*c* in the form of an animal image, such as the lizard shown in the bottom portion of FIG. 12. Preferably, head portion 367*c* overhangs or overlaps tail portion 368*c*. As in the case for each embodiment, the orientation may, of course, be reversed such that tail portion 368*c* overhangs or overlap heat portion 367*c*.

Figure 19:
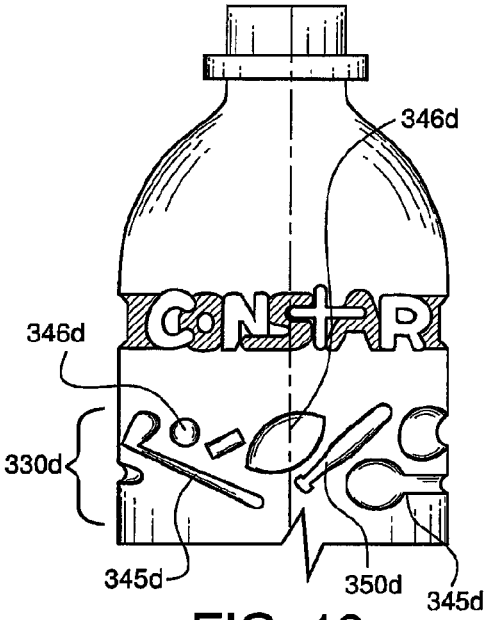
FIG. 19 illustrates another pair of portions for a container according to additional embodiments of the present invention.

The bottom portion of FIG. 19 illustrates a hoop support 330*d* of dome 334*d*. Hoop support 330*d* includes plural, spaced apart elements 350*d* in the form of sports equipment, some of which are generally elongated, such as baseball bats, hockey sticks, tennis rackets, golf clubs, and the like, and others of which are squat or round or ball-like, such as circles to represent balls, footballs, rugby balls. Other shapes may also included, such as rectangles to represent a hockey puck. The generally elongated elements are identified by reference numeral 345*d* and the stout elements are identified by reference numeral 346*d*. Elements 345*d* and 346*d* are mutually overlapping such that a vertical line drawn through hoop support 330*d* contacts or intersects at least two elements 350*d*.

Preferably, the portions of hoop supports 330*a*, 330*b*, 330*c*, and 330*d* outside of the identified features 350*a*, 350*b*, 350*c*, and 350*d*, and outside their complimentary or additional raised or recessed features (not shown in the figures), are circular in transverse cross section without vertically oriented ribs or corrugations. And the innermost surfaces of the recessed portions of the ribs are coincident with a circular cylinder having its centerline collinear with the bottle longitudinal centerline. If any of the surfaces of the ribs are raised, then the outermost surfaces of the raised portions are coincident with a circular cylinder having its centerline collinear with the bottle longitudinal centerline. The present invention, however, is not limited to structure described in this paragraph.

Figure 7:
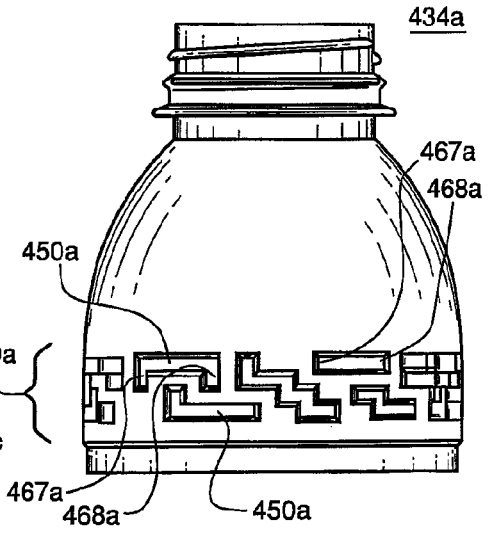
FIG. 7 illustrates a portion of a container according to another embodiment of the present invention.

FIG. 7 illustrates another aspect of the present invention. A hoop support 430*a* includes plural, spaced apart elements 450*a* that together extend around the circumference of dome 434*a*. Each segment 450*a* comprises at least one rectangular block. Some of the segments 450*a* are formed of an arrangement of several continuous blocks. Preferably, each block has a longitudinal centerline that is parallel or perpendicular to the centerlines of all other blocks to form a geometric pattern.

The height (in an elevational view, as shown in FIG. 7, and in the direction of the arrow) of hoop support 430*a* is generally greater than one segment. Preferably, some segments 450*a* have blocks oriented such that their longitudinal axes are horizontal, and at least one of a left portion 467*a* or a right portion 468*a* overhangs or overlaps an adjacent portion of a segment 450*a* below it. As shown in the center of FIG. 7, some blocks may be formed in a stair-step format having a top portion 467*a* that overhangs or overlaps a portion of it adjacent segment and a bottom portion 468*a* that is overhung or overlapped by its adjacent segment.

Figure 17:
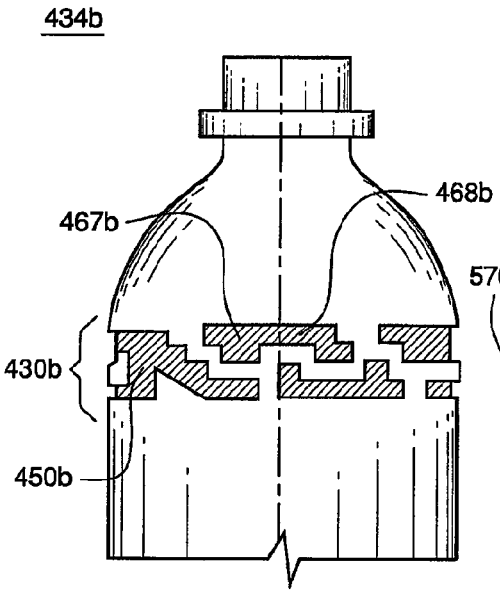
FIG. 17 illustrates a portion of a container according to another embodiment of the present invention.

FIG. 17 illustrates a hoop support 430*b* having segments 450*b* that are block-like and oriented such that the blocks have longitudinal axes that are mutually parallel. Segments 450*b* are similar to segments 450*a* of FIG. 7, but larger and more densely packed.

Figure 8:
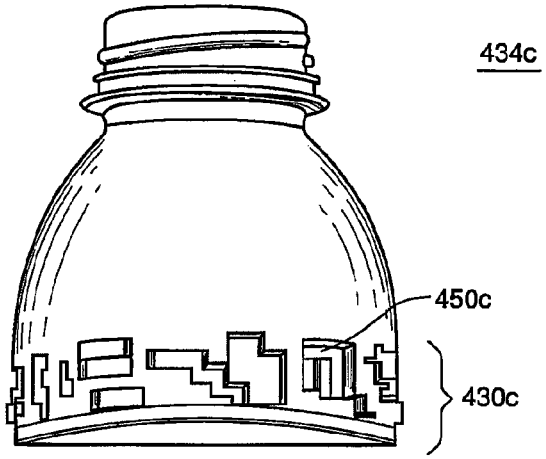
FIG. 8 illustrates a portion of a container according to another embodiment of the present invention.

FIG. 8 illustrates a hoop support 430*c* that includes rectangular segments 450*c* that continuously extend around the circumference of dome 434*c*. Segments 450*c* include discrete blocks that are connected to adjacent blocks at their boundaries to form a continuous ring. Preferably, each block has a longitudinal centerline that is parallel or perpendicular to the centerlines of all other blocks to form a geometric pattern.

Preferably, the radial dimension (that is, radial depth or height) of each block is different from surrounding blocks or groups of blocks to form a radially steps, which may be arranged randomly or in a pattern.

The top portion of FIG. 24 illustrates a hoop support 430*d* having block-like segments that are joined together to form a continuous ring 450*d* about the circumference of dome 434*d*. Ring 450*d* includes alternating peaks 452*d* and valleys 454*d*. Each peak 452*d* and valley 454*d* includes substantially right angles because of the block-like segments that make up ring

450*d*. The upper boundaries of peaks 452*d* preferably are straight, collinear with adjacent peak boundaries, and horizontal. The lower boundaries of valleys 454*d* preferably are straight, collinear with adjacent valley boundaries, and horizontal. Rings 450*d* is generally in the form of a step function having a period that is not uniform about the circumference. The width of the ring 450*d* (for example, the vertical dimension of any horizontal portion of ring 450*d*) may vary because, for example, of a protruding block-like segment 470*d*, as shown near the center of the top portion of FIG. 24, or because a block-like segment may have a width greater than its adjacent block-like segment.

Preferably, the portions of hoop supports 430*a*, 430*b*, 430*c*, and 430*d* outside of the identified features 450*a*, 450*b*, 450*c*, and 450*d* and outside their complimentary or additional raised or recessed features (not shown in the figures), are circular in transverse cross section without vertically oriented ribs or corrugations. And the innermost surfaces of the recessed portions of the ribs are coincident with a circular cylinder having its centerline collinear with the bottle longitudinal centerline. If any of the surfaces of the ribs are raised, then the outermost surfaces of the raised portions are coincident with a circular cylinder having its centerline collinear with the bottle longitudinal centerline. The present invention, however, is not limited to structure described in this paragraph.

Figure 18:
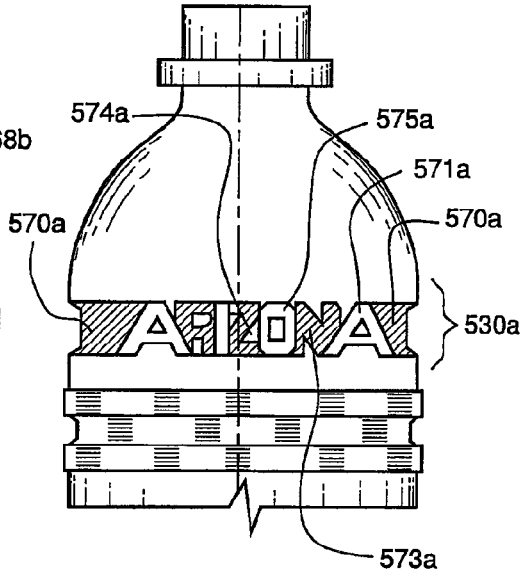
FIG. 18 illustrates another pair of portions for a container according to additional embodiments of the present invention.

The top portion of FIG. 18 and the top portion of FIG. 19 illustrate another aspect of the present invention. Referring to the embodiment of the top portion of FIG. 18, hoop support 530*a* includes a rib 570*a* formed about a portion of the circumference of dome 534*a* and indicia 571*a*. Indicia 571*a* may take any form, such as letters, as shown in the top portion of FIG. 18, numbers, logos, and the like. Preferably, indicia 571*a* is formed by a combination of recessed portions 573*a*, neutral-depth portions 574*a* that have approximately the same diameter as the surrounding surfaces of dome 534*a*, and raised portions 575*a*. For example, the surface forming the letter "R", most of the letter "Z", and most of the letter "N" are shown shaded to indicate that they are recessed relative to the surrounding dome surface, preferably with a bottom surface that is at the same radial distance as the bottom of rib 570*a*. Both letters "A", letter "I", and letter "O" are raised relative to the surrounding dome surface. The legs between the letters "A" and the interior (that is, the surrounded portions) of the letters "A", "R", and "O" share the same level or radial dimension as the surrounding dome surface. This dome surface may be curved (in transverse cross section) over hoop support 530*a*, and the preferred relationships of radial positions for the indicia are approximate.

Indicia, like letters 571*a*, may be approximately the same height (in elevational view) as the height of recess 570*a* or larger. Preferably, the letters 571*a* are no more than approximately three times the vertical height of rib 570*a*, or approximately no more than approximately two times the height of recess 570*a*. The present invention also encompasses indicia that fully extends around the circumference such that there is almost no rib or, in other words, no rib-like structure that is not filled with indicia. Preferably, indicia 571*a* are centered relative to rib 570*a*. As shown in the top portion of FIG. 18, rib 570*a* preferably is recessed. The present invention also encompasses a rib that raised relative to the surrounding surface of dome 534*a*, in which case letters 571*a* may be any combination of raised portions relative to the raised rib, recessed portions relative to the raise rib, or approximately coplanar with the surface of the raised rib. Whether the rib 571*a* is raised or recessed, the present invention encompasses indicia that is entirely recessed relative to the rib, or a combination of raised and coplanar with the rib, and also indicia that is entirely raised relative to the rib, or a combination of raised and coplanar with the rib. The present invention is not limited to any particular dimension or relationship described herein. Rather, the relationship between parts is provided for illustration.

Preferably, the bands of hoop supports 530*a* and 530*b* outside of the identified indicia 550*a* and 550*b* and outside their complimentary or additional raised or recessed features (not shown in the figures), are circular in transverse cross section without vertically oriented ribs or corrugations. And the innermost surfaces of the recessed portions of the indicia 550*a* and 550*b* are coincident with a circular cylinder having its centerline collinear with the bottle longitudinal centerline. And the raised surfaces of indicia 550*a* and 550*b* are coincident with a circular cylinder having its centerline collinear with the bottle longitudinal centerline. The present invention, however, is not limited to structure described in this paragraph.

The bottom of FIG. 10 illustrates another aspect of the invention. Hoop support 630*a* includes lower, middle, and upper rows 676*a*, 677*a*, and 678*a* of plural, discrete, spaced apart segments 679*a* that in general are spaced around the circumference of dome 634*a*. Rows 676*a*, 677*a*, and 678*a* are approximately horizontal in elevational view. Preferably, each one of segments 679*a* is oriented substantially horizontally and the segments gaps 680*a* therebetween. Preferably, the bottom and middle rows 676*a* and 677*a* are oriented such that each segment 679*a* of the middle row 677*a* is directly vertically above or overhanging the corresponding gap 680*a* of the lower row 676*a*. And the middle and top rows 677*a* and 678*a* are oriented such that each segment 679*a* of the top row 678*a* is directly above or overhanging the corresponding gap 680*a* in the middle row 677*a*. Preferably, all segments 679*a* have the same arc length, and the segments 679*a* of top row 678*a* are vertically aligned with the segments 679*a* of bottom row 676*a*, as shown in the bottom portion of FIG. 10. Preferably each of the gaps 680*a* of middle row 677*a* are equidistantly spaced from the end of segments 679*a* of top and bottom rows 676*a* and 678*a*, such that each gap 680*a* is centered relative to its corresponding surrounding rows.

The top of FIG. 12 illustrates a hoop support 630*b* that includes a pair of rows 676*b* and 677*b* of plural, discrete, spaced apart segments 679*b* that in general are spaced around the circumference of dome 634*b*. Rows 676*b* and 677*b* are exactly or approximately horizontal. Each segment 679*b* is oriented substantially horizontally, and ends 681*b* of adjacent segments of each row 676*b* and 677*b* define a gap 680*a* therebetween. Preferably, bottom and top rows 676*b* and 677*b* are oriented such that each segment 679*b* of top row 677*b* is directly vertically above or overhanging the corresponding gap 680*b* of the lower row 676*b*, and each segment 679*b* of bottom row 676*b* is directly vertically beneath the corresponding gap 680*b* of top row 677*b*. Preferably the gaps 680*b* of top row 677*b* are equidistantly spaced from ends 681*b* of segments 679*b* of bottom rows 676*b*, and the gaps 680*b* of bottom row 676*b* are equidistantly spaced apart from the ends of segments 679*b* of top row 677*b*.

Ends 681*b* taper downwardly such that each end 681*b* slopes away from the center of its segment, which forms a rounded point near the underside of each segment 679*b*. All segments 679*b* preferably are elongate and may have the same arc length (that is, in the elongated, circumferential dimension). The present invention encompasses any arc length(s) of segments 679*b*, such as shown in the top portion of FIG. 12, in which segments 679*b* of top row 677*b* may be slightly shorter in arc length dimension than segments 679*b* of bottom row 676*b*.

For the latter configuration, dome 634*b* may also include additional rows 678*b* and 678*b*'. Preferably, segments 679*b* of rows 678*b* and 678*b*' have vertical centerlines that are aligned with the vertical centerlines of segments 679*b* of row 677*b*, and taper to a rounded point near their undersides as described above. Preferably, each of segments 679*b* of uppermost row 678*b*' have an arc length that is smaller than that of the corresponding segment 679*b* of row 678*b*, which has an arc length that is smaller than that of the corresponding segment 679*b* of row 677*b* to produce a segmented triangle.

The bottom portion of FIG. 24 illustrates a hoop support 630*c* of dome 634*c*. Hoop support 630*c* includes an bottom and top row 676*c* and 677*c* of plural, discrete, spaced apart elements 650*c* having jagged sides 683*c* and pointed ends 684*c* on each end to form double ended lightning-bolts or electricity symbols that extend about the circumference of dome 634*c*. Each symbol 650*c* is oriented approximately horizontally. Preferably, each pointed end 684*c* has an oblique surface 685*c*, and symbols 650*c* of bottom row 676*c* are oriented such that oblique surface 685*c* of adjacent symbols 650*c* are spaced apart and facing, and preferably approximately parallel. Likewise, symbols 650*c* of top row 677*c* are oriented such that oblique surface 685*c* of adjacent symbols 650*c* are spaced apart and facing, and preferably approximately parallel. In this regard, each symbol either overhangs or undercuts its adjacent symbol. Preferably, gaps 680*c* between adjacent symbols 650*c* of bottom row 676*c* are approximately vertically aligned with gaps 680*c* formed in top row 677*c*. The present invention also encompasses gaps 680*c* that are not aligned.

Preferably, the portions of hoop supports 630*a*, 630*b*, and 630*c* outside of the identified features 650*a*, 650*b*, and 650*c*, and outside their complimentary or additional raised or recessed features, such as elements 679*b* of rows 678*b* and 678*b*', are circular in transverse cross section without vertically oriented ribs or corrugations. And the innermost surfaces of the recessed portions of the ribs are coincident with a circular cylinder having its centerline collinear with the bottle longitudinal centerline. If any of the surfaces of the ribs are raised, then the outermost surfaces of the raised portions are coincident with a circular cylinder having its centerline collinear with the bottle longitudinal centerline. The present invention, however, is not limited to structure described in this paragraph.

Figure 20:
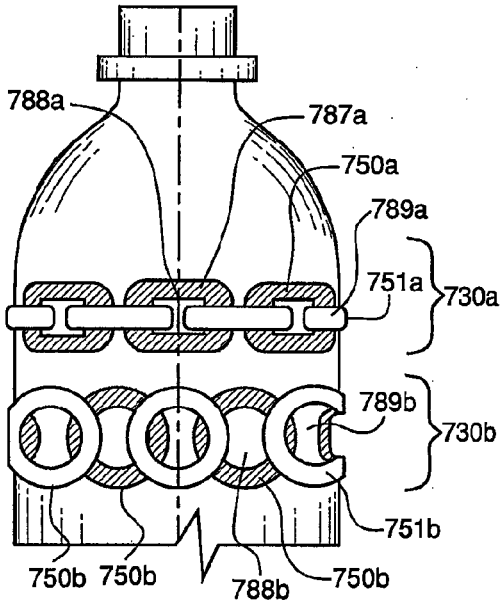
FIG. 20 illustrates another pair of portions for a container according to additional embodiments of the present invention.

The top and bottom portions of FIG. 20 illustrate another aspect of the present invention. Hoop support 730*a* of dome 734*a* includes a first series of repeating shapes 750*a* and a second series of repeating shapes 751*a* that are alternating with and appear to be overlaid onto first shapes 750*a*, as shown in the top portion of FIG. 20. Each first shape 750*a* forms a rectangle with rounded corners. Preferably shape 750*a* includes a recessed, upstanding rectangle 787*a* with a raised (that is, radially, relative to rectangle 787*a*) center portion 788*a*. Each second shape 751*a* is a raised (relative to both rectangle 787*a* and center portion 788*a*), horizontally oriented rectangle 789*a*. Horizontal rectangle 789*a* is elongated and overlays a portion of each adjacent upstanding rectangle 787*a* and of each adjacent upstanding center portion 788*a*.

Surfaces 787*a* and 788*a* form an appearance of a chain link that is upstanding, and surface 789*a* form the appearance of a link of the chain that is oriented horizontally. The present invention, of course, encompasses other structures to create the appearance of chain links, such as the upstanding rectangle 787*a* (or center portion 788*a*) being raised relative to other portions of hoop support 730*a*, or any other combination of raised and recessed portions. Any of portions 787*a*, 788*a*, and 789*a* may have varying depths and still be considered overlaid.

In this regard, the terms overlay or overlaid, as used herein, refer to a first structure having a raised surface relative to a connecting second structure such that the first structure appears to interrupt or be located on top of the second structure.

Hoop support 730*b* shown on the bottom portion of FIG. 20 includes a first series of repeating shapes 750*b* and 751*b* that are alternating with and appear to be overlaid onto first shapes 750*b*. Each first shape 750*b* includes a recessed ring 787*b* and a center portion 788*b* that is raised relative to ring 787*b*. Each second shape 751*b* includes a raised ring 789*b* and a center portion 790*b* that is recessed relative to ring 789*b*. Preferably, center portions 788*b* and 790*b* have the same radial position (that is, are approximately at the radial distance from the container's longitudinal centerline) as each other and the same radial position as the surrounding surface of dome 730*b*. The term ring is not limited to any particular shape, and encompasses structures other than round and encompasses irregular structures, and is not limited to structures that are continuous, and encompasses structures having interruptions.

Preferably, the portions of hoop supports 730*a* and 730*b* outside of the identified features 750*a* and 750*b*, and outside their complimentary or additional raised or recessed features (not shown in the figures) are circular in transverse cross section without vertically oriented ribs or corrugations. And the innermost surfaces of the recessed portions of the ribs are coincident with a circular cylinder having its centerline collinear with the bottle longitudinal centerline. The raised portions are coincident with a circular cylinder having its centerline collinear with the bottle longitudinal centerline. The present invention, however, is not limited to structure described in this paragraph.

The particular dimensions of hoop supports 30, 130, 230, 330, 430, 530, 630, and 730, including the dimension of the overlap of adjacent segments, the angle at which the segments are inclined (where applicable), and like parameter, may be chosen according to various parameters including container volume and diameter, wall thickness, material distribution, and like parameters, and may depend on the particular aesthetic appearance desired. Persons familiar with container engineering upon considering the present disclosure will understand the interplay among these parameters.

Any of the hoop supports 30, 130, 230, 330, 430, 530, 630, and 730 may be formed by either recessed structure, raised structure, or a combination of raised and recessed structure. For example, hoop supports or segments that are described or shown as recesses may also be formed by raised portions or a combination of raised and recessed portions, and hoop supports or segments that are shown as raised areas may also be formed by recesses or a combination of raised and recessed portions.

Figure 25:
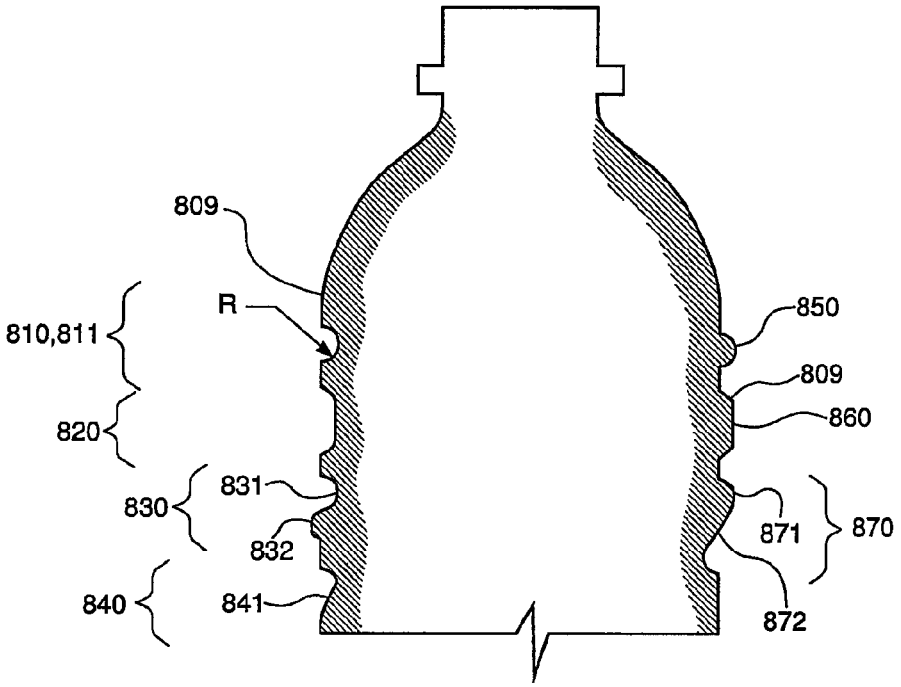
FIG. 25 illustrates various cross sections that the above embodiments may employ.
Figure 26:
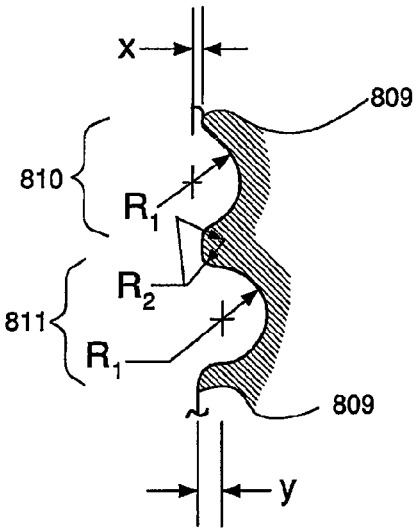
FIG. 26 is an enlarged portion of FIG. 25 illustrating hoop supports formed by a first type of recesses.

FIG. 25 illustrates options for forming the hoop supports. Referring to FIGS. 25 and 26 to illustrate some options for forming hoop supports that are recesses, a first curved recess 810 is formed in a container sidewall 809. Recess 810 is formed by a radius $R_1$, which has a center that lies outside a vertical line defined by container sidewall 809 such that the depth of recess 810 is less than radius $R_1$ by a radial offset X. Recess $R_1$ blends into sidewall 809 at a blend radius $R_2$, which has a negative curvature relative to recess radius $R_1$. Preferably, the choice of blend radius $R_2$ depends on related dimensions. Preferably, when offset dimension X is between zero and 30 percent of recess radius $R_1$, blend radius $R_2$ is equal to about 50% of recess radius $R_1$, or blend radius $R_2$ is less than about 50% of recess radius $R_1$.

A second curved recess 811, again shown in FIG. 25 and FIG. 26, is formed in container sidewall 809. Recess 811 is formed by a radius $R_1$, which has a center that lies inside a vertical line defined by container sidewall 809 such that the depth of recess 810 is greater than radius $R_1$ by a radial offset Y. Recess $R_1$ blends into sidewall 809 at a blend radius $R_2$, which has a negative curvature relative to recess radius $R_1$. Preferably, the choice of blend radius $R_2$ depends on related dimensions. Preferably, when offset dimension Y is less than or about equal to $R_1$, blend radius $R_2$ is less than or equal to recess radius $R_1$.

Figure 27:
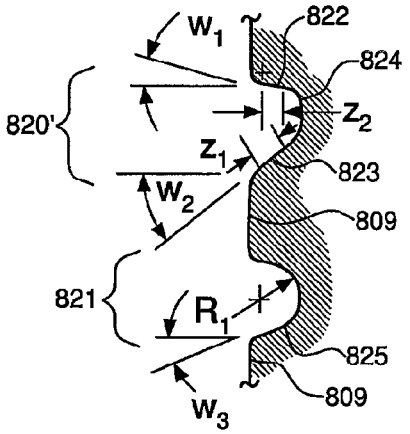
FIG. 27 is an enlarged portion of FIG. 26 illustrating hoop support structure formed by a second type of recess.

Referring to FIGS. 25 and 27, a recess 820 may be formed in container sidewall 809. Recess 820 is shown in FIG. 25 as symmetrical about a horizontal centerline. In FIG. 27, a recess 820' is illustrated that may include angled sidewalls 822 and 823 and a relative flat portion 824 (in transverse cross section) therebetween. The preferred minimum angle $\omega_1$ of wall 822 is approximately 2 degrees from horizontal to enable ready removal of the container from a mold. The preferred maximum angle $\omega_2$ of wall 823 is approximately 45 degrees. Angles $\omega_1$ and $\omega_2$ of between 2 degrees and 45 degrees are preferred when there is a substantially straight section $Z_1$ or $Z_2$ in the base or sidewall of the recess 820 (that is, if either $Z_1$ or $Z_2$ is greater than zero). This preferred range applies also to the symmetrical walls of recess 820 of FIG. 25.

Recess 821 is formed by a radius $R_1$ and includes a substantially straight sidewall 825 that forms an angle $\omega_3$ with a horizontal line. The angle range of $\omega_3$ preferably is chosen according to the range described above for recess 820.

Referring to FIG. 25, the hoop supports described herein may be formed according to combination 830, which includes a recess 831 and a raised structure 832. Recess 831 may be formed as described above or by any other configuration. Raised structure 832 may be formed by any structure. Hoop support may also be formed by a recess 840 having at least one boundary wall 841 that gradually merges into container wall 809.

The right side of FIG. 25 illustrates some options for forming the hoop support by raised surfaces. For example, rounded raised surface 850 may be inverse of recess 810 or 811, and raised surface 860 may be the inverse of recess 820, 820', or 821. Combination 870 includes raised and recessed portions 870 and 871. Raised portion 870 has an upper wall that extends outwardly from sidewall 809 and preferably may be considered to be the inverse of the walls described by recess 810 or 811. And the recessed portion 870 has a lower wall that extends inwardly from sidewall 809 as described by recess 810 or 811. The lower wall of raised portion 870 and upper wall of recess portion 871 preferably smoothly merge together.

The structural features of the hoop supports described in each of the embodiments above are preferably formed by recesses in the dome wall. The present invention, however, is not limited to any specific depth of the recesses, and the present invention encompasses forming the features of the hoop supports as raised portions. The present invention encompasses the features, such as elements bearing the reference numerals 50, 150, 250, 350, 450, 550, 650, or 750 (with any appended letter designation, including structures that are given additional reference numerals, formed by recessed surfaces, raised surfaces, textured surfaces, surfaces approximately coplanar with the surrounding dome surfaces where abutting recessed or raised surfaces, and any combinations.

What is claimed:

1. A bottle comprising:

a bottom portion comprising:

an enclosed base having a standing ring;

a body extending upwardly from the base and defining a vertical axis oriented perpendicular to the standing ring; and a top portion extending upwardly and away from the body, the top portion consisting essentially of:

a substantially circumferential hoop support defining a generally horizontally-oriented band that consists essentially of plural segments, each one of the segments having a lower portion, an intermediate portion extending from the lower portion, and an upper portion extending from the intermediate portion relative to the vertical axis of the body, the lower portions being located closer to the standing ring than the upper portions, and each one of the segments being (i) separate and spaced apart from circumferentially adjacent segments, (ii) elongate, and (iii) vertically overlapping relative to the vertical axis of the body, such that the upper portion of each segment is vertically located over the lower portion of a circumferentially adjacent segment, a tangent to a centerline of the upper portion proximate the end of the upper portion has a negative slope and a tangent to a centerline of the lower portion proximate the end of the lower portion has a positive slope, whereby the segments give the appearance of circumferentially spaced apart, vertically spaced, twisted strands;

a dome that extends upwardly from the hoop support; and a finish at an uppermost portion of bottle.

2. The bottle of claim 1 wherein a rib is recessed relative to surrounding body surfaces.

3. The bottle of claim 1, further comprising a plurality of panels capable of inward deflection in response to internal vacuum.

4. A bottle comprising:

a bottom portion comprising:

an enclosed base having a standing ring;

a body extending upwardly from the base and devoid of a waist, the body defining a vertical axis; and a top portion extending upwardly from the body, the top portion consisting essentially of:

a finish at an uppermost portion of bottle;

a dome that extends upwardly toward the finish; and a substantially circumferential hoop support defining a generally horizontally-oriented band located at a lower portion of the dome, the hoop support comprising plural discrete shapes arranged in a mutually overhanging and undercutting pattern relative to the vertical axis of the body, such that each shape overlaps or undercuts at least one circumferentially adjacent shape, each one of the shapes having a lower portion, an intermediate portion extending from the lower portion, and an upper portion extending from the intermediate portion relative to the vertical axis of the body, and a tangent to a centerline of the upper portion proximate the end of the upper portion has a negative slope and a tangent to a centerline of the lower portion proximate the end of the lower portion has a positive slope, whereby the shapes give the appearance of circumferentially spaced apart, twisted strands.

5. The bottle of claim 4 wherein the shapes are identical to one another.

6. The bottle of claim 4 wherein each shape is spaced apart from adjacent shapes.

7. The bottle of claim 4, further comprising a plurality of panels capable of inward deflection in response to internal vacuum.

8. A hot fill bottle comprising:

a bottom portion including:

an enclosed base having a standing ring;

a body extending upwardly from the base and defining a vertical axis, said body including at least one vacuum panel and at least one rib; and a top portion including:

a finish at an uppermost portion of the bottle;

a dome that extends downwardly from the finish; and a substantially circumferential hoop support defining a generally horizontally oriented band located between the dome and the body of the bottom portion, the hoop support comprising at least one of:

a) a wave-like rib wherein the rib (i) is circumferentially continuous and (ii) has an upper surface and a lower surface forming a repeating pattern of peaks and valleys relative to the vertical axis of the body, wherein the upper surface and the lower surface are substantially the same distance apart from each other along the entire rib;

b) plural discrete segments that are oriented about the circumference of the body such that each segment has circumferentially adjacent segments on opposing sides thereof, each one of the segments having a first inclined lateral wall and an opposing second inclined lateral wall, each one of the lateral walls either overhanging or undercutting the lateral walls of circumferentially adjacent segments relative to the vertical axis of the body;

c) plural discrete shapes arranged in a mutually overhanging and undercutting pattern relative to the vertical axis of the body, such that each shape overlaps or undercuts at least one circumferentially adjacent shape;

d) plural block-like segments, at least some of said plural block-like segments being continuous rectangles including portions that are perpendicular to the vertical axis of the body and portions that are parallel to the vertical axis of the body, at least part of said rectangles being radially raised or radially recessed relative to adjacent bottle diameter;

e) indicia formed by surfaces of at least two radial depths; and f) a first series of repeating shapes and a second series of repeating shapes, the first series of shapes alternating with the second series of shapes, the second series of shapes interfering with the first series of shapes such that a portion of each one of the second series of shapes appears to overlay a portion of each adjacent shape of the first series.

9. The bottle of claim 8, wherein the hoop support is disposed on a substantially flat cylindrical portion of the bottle.

10. The bottle of claim 8, further comprising a plurality of panels capable of inward deflection in response to internal vacuum.

11. The bottle of claim 8, wherein the bottom portion includes at least one circumferential rib.

12. A plastic bottle including a base having a standing ring, a body defining a vertical axis that is perpendicular to the standing ring and includes at least one vacuum panel and at least one rib, a dome, a finish, and at least one substantially circumferential hoop support located between the dome and the body, the hoop support comprising at least one of:

a) a wave-like rib wherein the rib (i) is circumferentially continuous and (ii) has an upper surface and a lower surface forming a repeating pattern of peaks and valleys relative to the vertical axis of the body wherein the upper surface and the lower surface are substantially the same distance apart from each other along the entire rib;

b) plural discrete segments that are orientated about the circumference of the body such that each segment has circumferentially adjacent segments on opposing sides thereof, each one of the segments having a first inclined lateral wall and an opposing second inclined lateral wall, each one of the lateral walls either overhanging or undercutting the lateral walls of circumferentially adjacent segments relative to the vertical axis of the body;

c) plural discrete shapes arranged in a mutually overhanging and undercutting pattern perpendicular to the vertical axis of the body, such that each shape overlaps or undercuts at least one circumferentially adjacent shape;

d) plural block-like segments, at least some of said plural block-like segments being continuous rectangles including portions that are perpendicular to the vertical axis of the body and portions that are parallel to the vertical axis of the body, at least part of said rectangles being radially raised or radially recessed relative to adjacent bottle diameter;

e) indicia formed by surfaces of at least two radial depths; and f) a first series of repeating shapes and a second series of repeating shapes, the first series of shapes alternating with the second series of shapes, the second series of shapes interfering with the first series of shapes such that a portion of each one of the second series of shapes appears to overlay a portion of each adjacent shape of the first series.

13. The bottle of claim 12, wherein the hoop support is disposed on a substantially flat cylindrical portion of the bottle.

* * * * *